US006000737A

United States Patent [19]

Yiu

[11] Patent Number: 6,000,737

[45] Date of Patent: Dec. 14, 1999

[54] LOOP STRIKER

[75] Inventor: Arnold Yiu, Thornhill, Canada

[73] Assignee: Atoma International Corp., Newmarket, Canada

[21] Appl. No.: 08/932,423

[22] Filed: Sep. 17, 1997

[51] Int. Cl.[6] ..... E05B 15/02

[52] U.S. Cl. ..... 292/340; 292/DIG. 43; 292/341.14

[58] Field of Search ..... 292/281, 340, 292/341.13, 341.14, 246, DIG. 42, DIG. 43, DIG. 71, 285, DIG. 53; 24/265 AL, 712.8; 403/188–191

[56] References Cited

U.S. PATENT DOCUMENTS

| | | | |
|---|---|---|---|
| D. 212,123 | 8/1968 | Foote . | |
| 459,869 | 9/1891 | Lighthouse . | |
| 582,186 | 5/1897 | Dorrance . | |
| 1,479,213 | 1/1924 | Benedict . | |
| 1,690,408 | 11/1928 | Hasenflue . | |
| 1,692,295 | 11/1928 | Gerard . | |
| 2,186,747 | 1/1940 | Albin . | |
| 2,767,571 | 10/1956 | Dingman et al. . | |
| 2,795,947 | 6/1957 | Peras . | |
| 2,977,785 | 4/1961 | Beckman . | |
| 3,239,260 | 3/1966 | Beckman . | |
| 3,296,694 | 1/1967 | De Mastry et al. . | |
| 3,572,793 | 3/1971 | Cole . | |
| 3,667,791 | 6/1972 | Kazaoka et al. . | |
| 3,680,902 | 8/1972 | Slattery . | |
| 3,743,335 | 7/1973 | Reilhac et al. . | |
| 3,767,243 | 10/1973 | Yoshimura . | |
| 3,796,076 | 3/1974 | Máyabayashi | 70/240 |
| 4,079,974 | 3/1978 | Roper | 292/281 |
| 4,323,271 | 4/1982 | Taniguchi . | |
| 4,432,575 | 2/1984 | Garvey et al. . | |
| 4,437,410 | 3/1984 | Stoller | 105/378 |
| 4,451,071 | 5/1984 | Striese et al. . | |
| 4,466,645 | 8/1984 | Kobayashi . | |
| 4,470,626 | 9/1984 | Gergoe et al. . | |
| 4,544,192 | 10/1985 | Angle et al. . | |
| 4,602,813 | 7/1986 | Gergoe et al. . | |
| 4,650,231 | 3/1987 | Shimura et al. . | |
| 4,671,548 | 6/1987 | Haberle | 292/216 |
| 4,756,565 | 7/1988 | Myslicki et al. . | |
| 4,775,176 | 10/1988 | Ikeda . | |
| 4,838,588 | 6/1989 | Hayakawa et al. . | |
| 4,917,417 | 4/1990 | Aubry . | |
| 4,941,696 | 7/1990 | Yamada et al. . | |
| 4,946,208 | 8/1990 | Myslicki et al. . | |
| 4,981,313 | 1/1991 | Makamura | 292/340 |
| 4,998,759 | 3/1991 | Peterson et al. . | |
| 5,050,917 | 9/1991 | Hamada et al. . | |
| 5,141,270 | 8/1992 | Shibata . | |
| 5,209,531 | 5/1993 | Thau . | |
| 5,234,238 | 8/1993 | Takimoto . | |
| 5,263,752 | 11/1993 | Phail-Fausey et al. . | |
| 5,316,354 | 5/1994 | Arabia, Jr. et al. . | |
| 5,342,103 | 8/1994 | Tame et al. . | |
| 5,461,209 | 10/1995 | Yamada et al. . | |
| 5,501,495 | 3/1996 | Claucherty . | |

FOREIGN PATENT DOCUMENTS

| | | |
|---|---|---|
| 657299 | 2/1963 | Canada . |
| 1 191 174 | 7/1985 | Canada . |
| 2 134 519 | 8/1995 | Canada . |
| 54-149129 | 11/1979 | Japan . |
| 1-223276 | 9/1989 | Japan . |
| 1 340 706 | 12/1973 | United Kingdom . |
| 1 430 230 | 3/1976 | United Kingdom . |
| 1 574 763 | 9/1980 | United Kingdom . |
| 2061369 | 5/1981 | United Kingdom . |

*Primary Examiner*—Flemming Saether
*Assistant Examiner*—Gary Estremsky
*Attorney, Agent, or Firm*—Pillsbury Madison & Sutro LLP

[57] ABSTRACT

A striker assembly has a keeper and a mounting plate. The keeper has a generally U-shape. The mounting plate has a groove and at least one aperture for receiving a fastener for mounting the striker assembly to a mounting surface. The groove nestingly receives end portions of the keeper. The end portions and groove are configured to interlock together to resist relative lateral movement between the keeper and the mounting plate. The striker assembly is heat treated until the keeper has a hardness of about Rc 30–40.

24 Claims, 4 Drawing Sheets

LOOP STRIKER

FIELD OF INVENTION

This invention relates to a striker assembly for operation with a latch. In particular, this invention relates to a loop striker assembly for installation within compact volumes of a vehicle.

BACKGROUND OF INVENTION

Strikers are used in cooperation with a latch for closing and securing doors, hoods and trunks. There are numerous examples of strikers and cooperating latches, known in the automotive industry.

The current trend in the automotive industry is to design more features into a smaller vehicle. As a result, the available volume for particular components is being reduced. Notwithstanding the need for smaller component parts, each part must still meet or exceed the applicable safety standards, including the United States Federal Motor Vehicle Safety Standard (FMVSS #206).

A typical striker will have a mounting plate having a U-shaped keeper. The keeper is bolted, or otherwise permanently attached to the mounting plate. While many improvements to strikers have been made, none address the joint or connection between the keeper and the mounting plate.

SUMMARY OF THE INVENTION

The disadvantages of the prior art may be overcome by providing a striker having an improved connection between components thereof while maintaining or reducing the volume of the striker.

It is desirable to provide a striker having a reduced size and improved strength and durability characteristics.

According to one aspect of the invention, there is provided a striker comprising a base plate and a loop keeper. The base plate and a loop is connected to the base plate in such a manner so as to provide a low profile and at least two engagements.

According to another aspect of the invention, there is provided a striker assembly having a keeper and a mounting plate. The keeper has a generally U-shape. The mounting plate has a groove and at least one aperture for receiving a fastener for mounting the striker assembly to a mounting surface. The groove nestingly receives end portions of the keeper to space a bight portion of the U-shape from the mounting plate. The end portions and groove are configured to interlock together to resist relative lateral movement between the keeper and the mounting plate.

According to another aspect of the invention, there is provided a striker assembly which is heat treated until the keeper has a hardness of about Rc 30–40.

DESCRIPTION OF THE DRAWINGS

In drawings which illustrate embodiments of the present invention.

DESCRIPTION OF THE INVENTION

Figure 1:
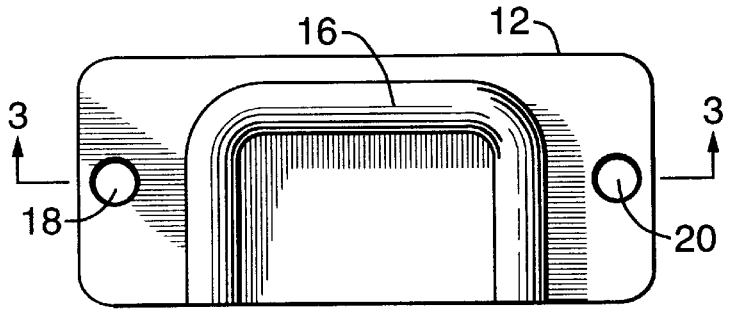
FIG. 1 is a bottom plan view of the mounting plate of the striker assembly of a first embodiment of the present invention.
Figure 2:
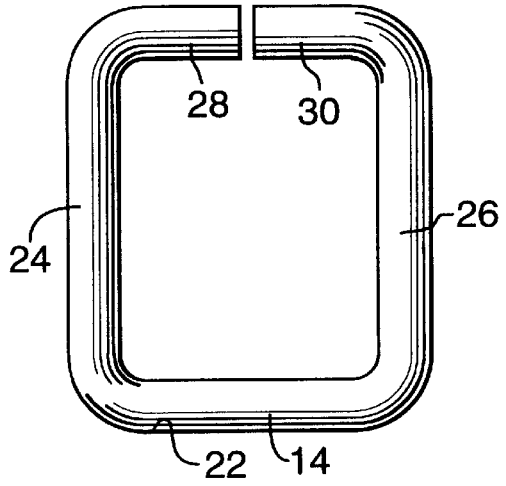
FIG. 2 is a top plan view of the keeper of the striker assembly of FIG. 1.

Referring to FIGS. 1 to 4, a first embodiment of a striker assembly of the present invention is illustrated. Striker assembly 10 generally comprises a mounting plate 12 and a keeper 14.

Mounting plate 12 has a stamped or formed groove or channel 16. Groove 16 is sized and configured to fully receive part of keeper 14. Mounting plate 12 has two apertures 18 and 20 for receiving bolts or other suitable fastener means to attach the mounting plate 12 to a vehicle frame. The placement, size and number of the apertures 18 and 20 will depend upon the specifications of the particular vehicle into which the striker assembly 10 is to be incorporated.

Keeper 14 has a striking portion 22, legs 24 and 26 and feet 28 and 30. Striking portion 22, legs 24 and 26 are in a generally U-shape with the striking portion 22 in the bight of the U-shape. Legs 24 and 26 extend generally parallel to each other. Feet 28 and 30 extend at an angle and preferably substantially perpendicular to legs 24 and 26, respectively. In the first embodiment, feet 28 and 30 extend inwardly such that the keeper 14 is in a closed loop configuration. Keeper 14 is preferably a wire rod which is formed or bent into the desired shape. Feet 28 and 30 are at the opposite ends of the wire rod comprising keeper 14.

In the preferred embodiment, mounting plate 12 is a low carbon steel such as SAE 1008/1010 plate steel and keeper 14 is a medium carbon steel such as SAE 1040 steel.

Keeper 14 has mounting portions thereof fitted or nested within groove 16 of mounting plate 12. The diameter of keeper 14 and the inside diameter of groove 16 are selected such that keeper 14 is flush with the bottom surface of mounting plate 12 and keeper 14 has a minimum of play once fitted in groove 16. Preferably, keeper 14 frictionally engages within the groove 16.

The mounting portions of the keeper comprise two end portions, including end portions or bases of legs 24 and 26, and feet or stems 28 and 30, which are fully registered within the groove 16. The balance of the rod forming the keeper 14 may be considered to be latch engaging portions of the keeper. The latch engaging portions of legs 24 and 26 and the striking portion 22 is spaced from the mounting plate 12 by the portions of legs 24, 26. Additionally, shallow crevices 32 and 34 will be presented along opposite edges of the groove 16. Crevices 32 and 34 receive welding material to bond and integrate keeper 14 and mounting plate 12.

As shown, the mounting portions have the longitudinal axis thereof extending in generally parallel relation to the mounting plate 12.

Figure 4:
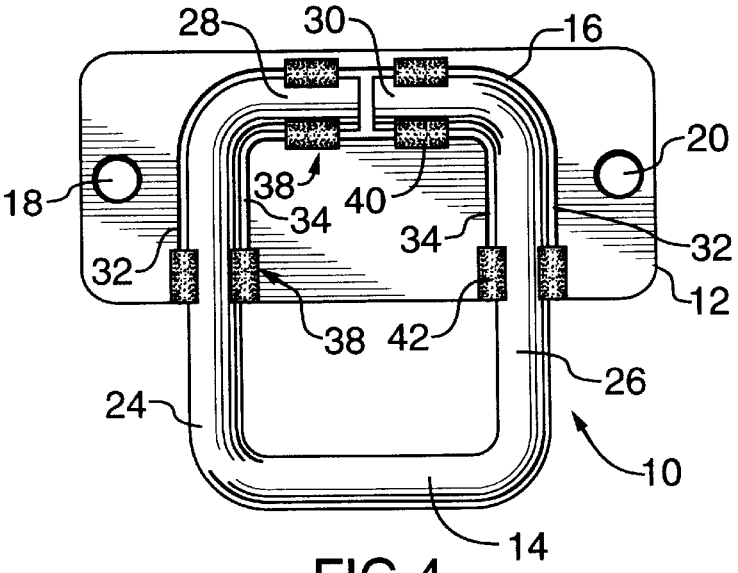
FIG. 4 is a bottom plan view of the striker assembly of the present invention.

Preferably, keeper 14 and mounting plate 12 are welded together at four locations, 36, 38, 40 and 42 using a gas metal arc welding or MIG welding techniques using electrode wire material ER 70S-6. Although four welds as illustrated in FIG. 4 is preferred, it is readily understood by those skilled in the art that fewer or greater number of welds or types of welds may be used with satisfactory results. The number and location of welds will depend upon the amount and type of wire material to be used and the specified strength characteristics to be achieved.

Figure 3:
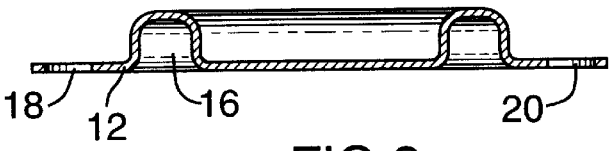
FIG. 3 is a sectional view of the mounting plate of FIG. 1, along the line 3—3.

As best illustrated in FIG. 3, the mounting plate 12 has a relatively low profile. Since the mounting portions of the keeper 14 are fully registered or nested within the groove 16 to lie flush with the bottom surface of the mounting plate 12, the thickness of the assembled striker assembly will be approximately the diameter of the keeper 14 and the thickness of the mounting plate 12.

To meet the minimum strength requirements as specified in FMVSS #206, only the keeper 14 should be heat treated to achieve about a Rc 30–40 hardness. However in the preferred embodiment, the entire striker assembly 10 is heat treated to Rc 30–40 as measured on the keeper 14 after welding. Preferably, the heat treatment is austempering. The added benefit of heat treating the entire striker assembly 10 is that the heat treatment will relieve the stresses created during the welding process.

The assembled and heat treated striker assembly 10 can be installed on the vehicle to be used in cooperation with a latch assembly to close and lock a door, trunk or hood of a vehicle. In the embodiment illustrated in FIG. 4, the keeper 14 extends in the same plane as the mounting surface of the vehicle or closure member. Bolts or rivets extend through holes 18 and 20 and attach the striker assembly 10 to the mounting surface.

Once installed on a mounting surface, the striker assembly 10 of the present invention has two engagements for durability. First, the welds 36, 38, 40 and 42 maintain the integrity of the striker assembly 10, preventing the keeper 14 from separating from the mounting plate 12. Secondly, the feet 28 and 30 within groove 16 will mechanically retain the keeper 14 to the mounting plate 12 as long as the mounting plate 12 remains attached to the mounting surface. It is thus apparent that the feet 28 and 30 must extend at an angle to the legs 24 and 26, respectively, to interlock the keeper 14 to the mounting plate 12 when the striker assembly 10 is in an installed condition. The configuration of legs 24 and 26 and feet 28 and 30 prevent the keeper 14 from moving laterally relative to the mounting plate, i.e. slipping out, in the event of a weld failure. The lateral direction can be in any direction in the same general plane of mounting plate 12.

Figure 5:
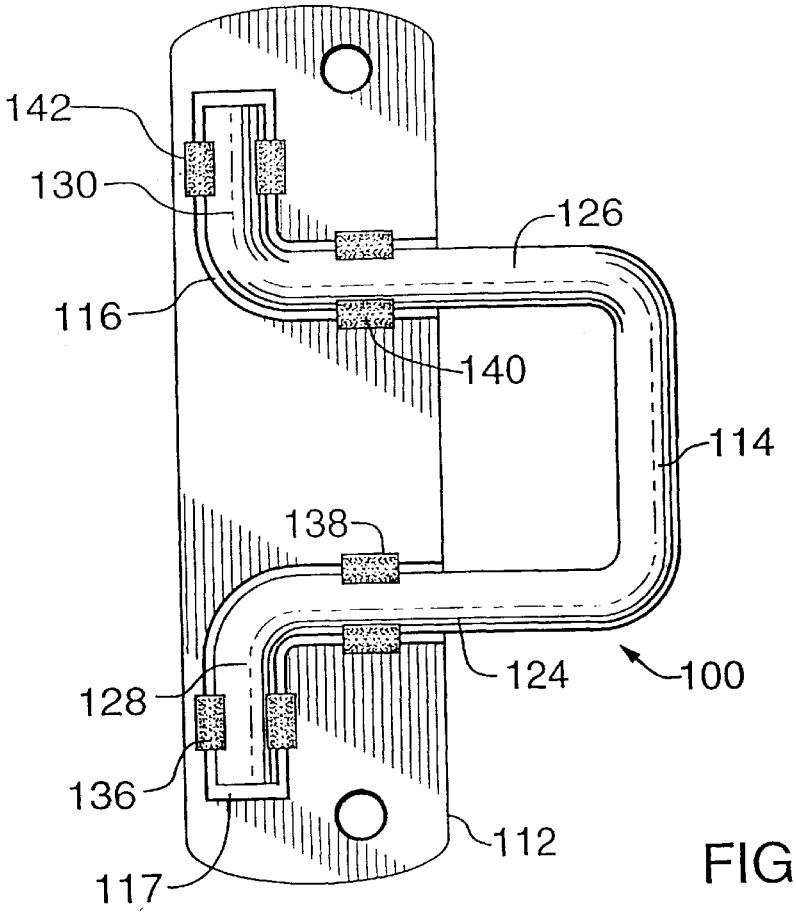
FIG. 5 is a bottom plan view of a second embodiment of the striker assembly of the present invention.

Referring to FIG. 5, a second embodiment of the present invention is illustrated. The striker assembly 100 of the second embodiment is similar to the first embodiment except that the feet 128 and 130 of keeper 114 extend outwardly rather than inwardly. The groove 16 of mounting plate 12 is replaced with two L-shaped grooves 116 and 117. The base of the L-shaped grooves 116 and 117 receive feet 128 and 130 and the stem of the L-shaped grooves receive part of legs 124 and 126, respectively. Keeper 114 is welded to mounting plate 112 at welds 136, 138, 140 and 142.

Figure 6:
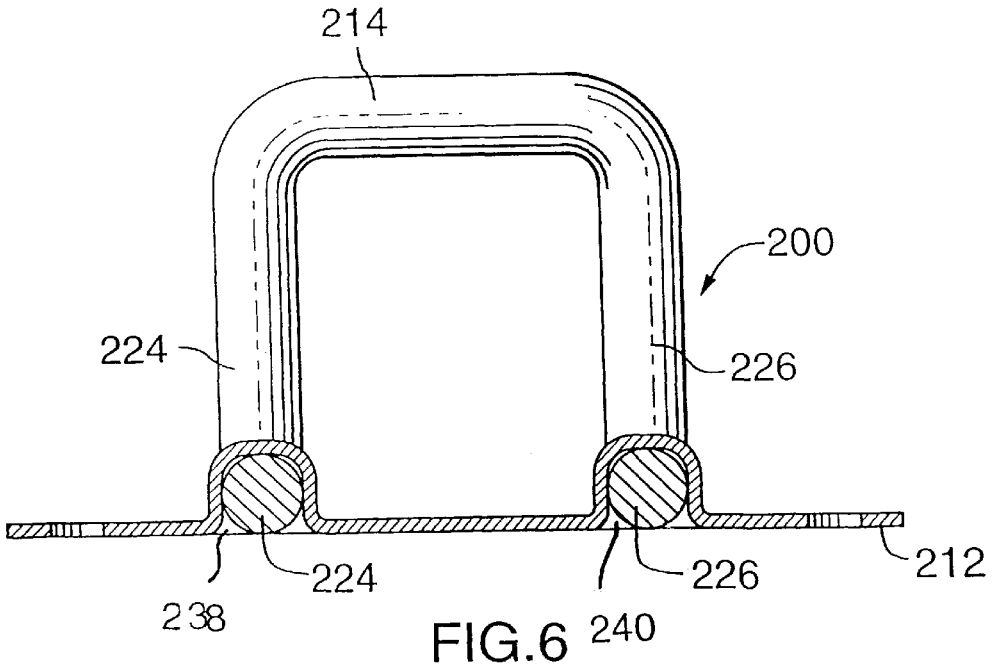
FIG. 6 is a partial sectional view of a third embodiment of the striker assembly of the present invention with the keeper extending perpendicular to the mounting plate.

Referring for FIG. 6, a third embodiment of the present invention is illustrated. The striker assembly 200 of the third embodiment is similar to the first and second embodiments except that the legs 224 and 226 of keeper 214 have an L-shape so that the keeper extends generally perpendicular to the mounting plate 212. The mounting portions remain parallel to the mounting plate 212. Keeper 214 is welded to mounting plate 212 at welds 238 and 240 as shown.

Figure 7:
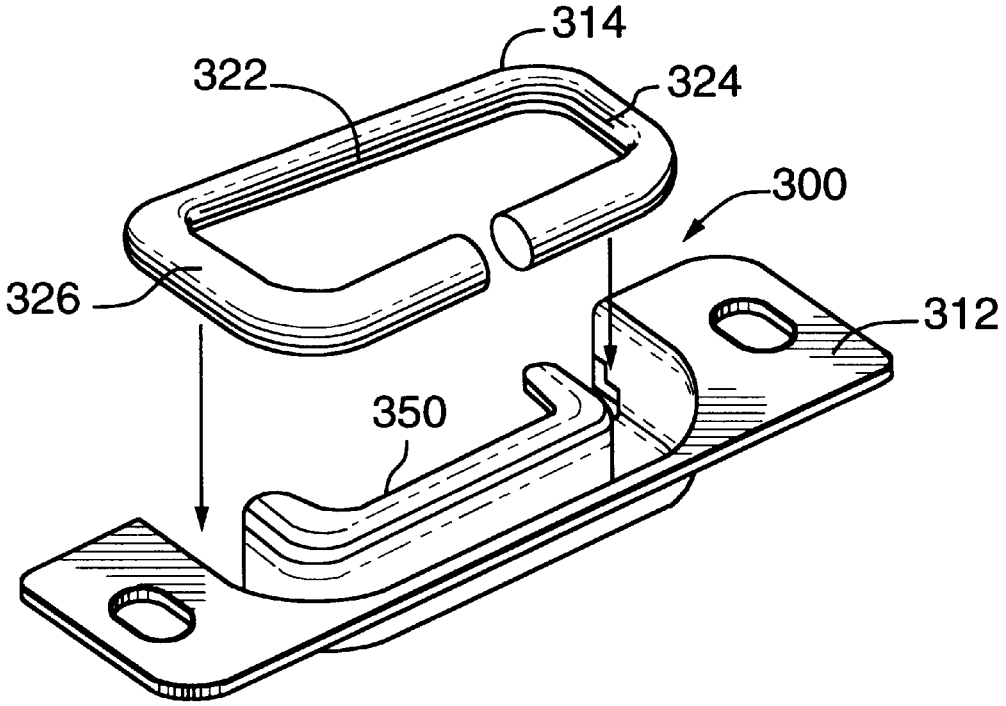
FIG. 7 is a perspective exploded view of a fourth embodiment of the striker assembly of the present invention.
Figure 8:
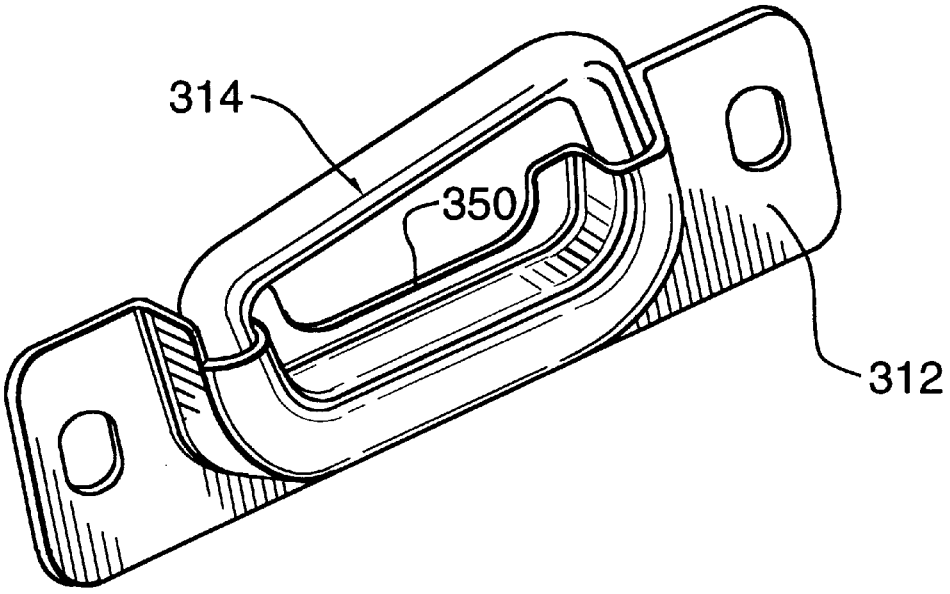
FIG. 8 is a perspective view of the striker assembly of FIG. 7 in an assembled condition.

Referring to FIGS. 7 and 8, a fourth embodiment of the present invention is illustrated. The striker assembly 300 is similar to the other embodiments except that legs 324 and 326 of keeper 314 are of different lengths angling the striker portion 322 with respect to the mounting plate 312. In addition, mounting plate 312 has an edge 350 trimmed to reduce weight of the striker assembly 300 and to open the inner region of the keeper 314 improving the compactness of the striker assembly.

Figure 9:
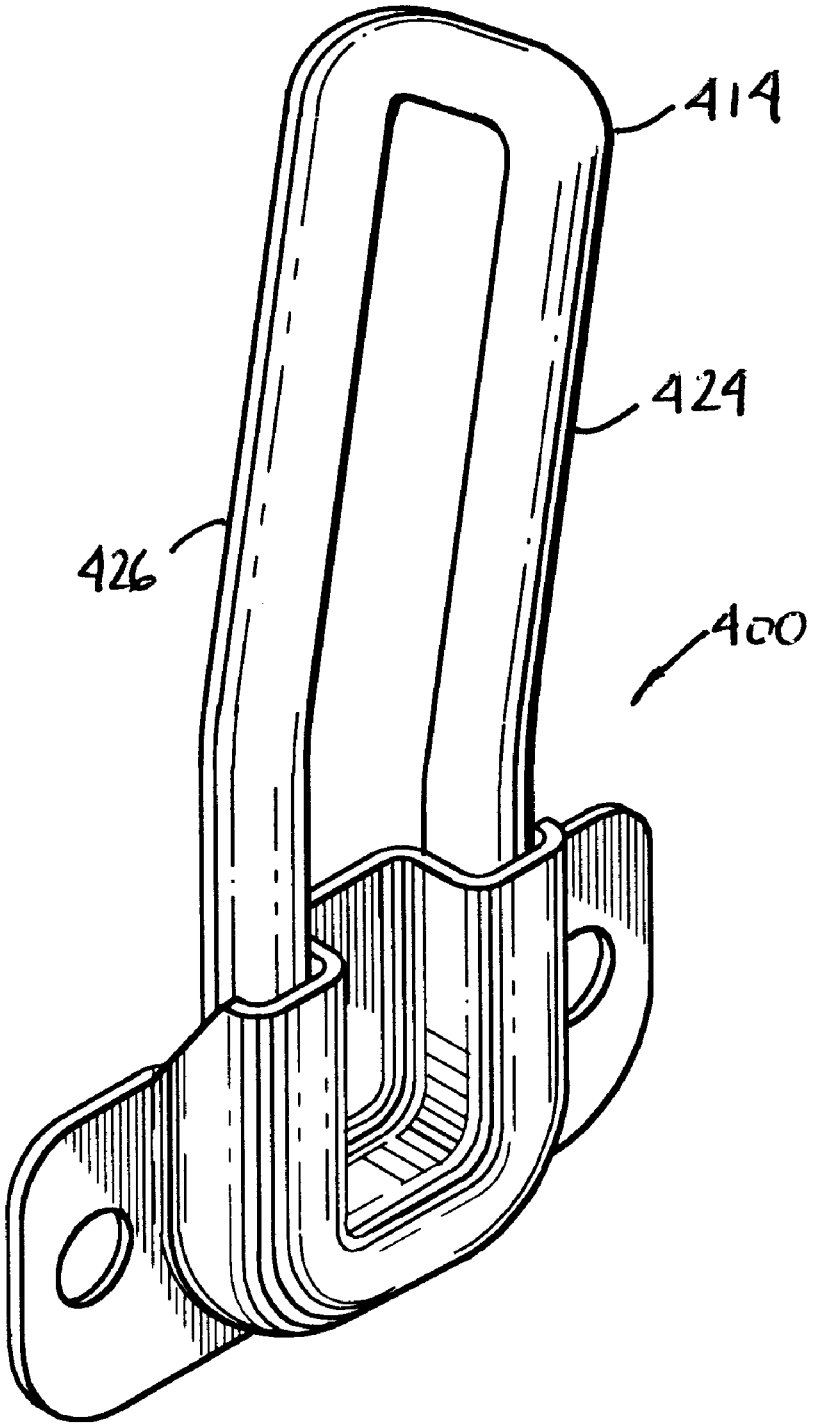
FIG. 9 is a perspective view of a fifth embodiment of the striker assembly of the present invention.

Referring to FIG. 9, a fifth embodiment of the present invention is illustrated. The striker assembly 400 is similar to the other embodiments except that the legs 424 and 426 of keeper 414 are elongated.

The preceding specific embodiments are illustrative of the practice of the present invention. It is to be understood, however, that other expedients known or apparent to those skilled in the art or disclosed herein may be employed without departing from the spirit of the invention.

I claim:

1. A striker assembly for cooperation with a latch, said striker assembly comprising a mounting plate and keeper;

said mounting plate having grooved means for fixedly mounting said keeper to said mounting plate in a manner that prevents relative movement between said keeper and said mounting plate;

said keeper comprising a rod having mounting portions nestingly received within said grooved means when mounted, said rod further including latch engaging portions integrally connected with said mounting portions and including a striker portion for engaging the latch, said mounting portions disposed on one side of said mounting plate and fixed to said mounting plate without extending through said mounting plate, said rod having a longitudinal axis, and wherein said longitudinal axis, at least along said mounting portions of said rod, is disposed in generally parallel relation to said mounting plate.

2. A striker assembly as claimed in claim 1 wherein said mounting portions are welded to said mounting plate to fix said keeper to said mounting plate when said mounting portions are nested in said groove.

3. A striker assembly as claimed in claim 2 wherein said mounting portions comprise two end portions each having an L-shape.

4. A striker assembly as claimed in claim 3 wherein said L-shape has a base and a stem and the base of each end portion are directed in opposite directions.

5. A striker assembly as claimed in claim 4 wherein said L-shape has a base and a stem and the base of each end portion are directed towards each other.

6. A striker assembly as claimed in claim 3 wherein said L-shape has a base and a stem and the base of each end portion are directed away from each other.

7. A striker assembly as claimed in claim 6 wherein said striker assembly is heat treated.

8. A striker assembly as claimed in claim 6 wherein said striker assembly is heat treated until the keeper has a hardness of about Rc 30–40.

9. A striker assembly as claimed in claim 3 wherein said L-shape has a base and a stem and the base of each end portion are directed in the same direction.

10. A striker assembly as claimed in claim 9 wherein said striker assembly is heat treated.

11. A striker assembly as claimed in claim 9 wherein said striker assembly is heat treated until the keeper has a hardness of about Rc 30–40.

12. A striker assembly according to claim 1, wherein said longitudinal axis along said latch engaging portions is disposed in generally parallel relation to said mounting plate.

13. A striker assembly according to claim 1, wherein portions of said longitudinal axis along said latch engaging portion are disposed in generally perpendicular relation to said mounting plate, and wherein portions of said longitudinal axis along said striker portion are disposed in generally parallel relation to said mounting plate.

14. A striker assembly for cooperation with a latch, said striker assembly comprising a mounting plate and keeper;

said mounting plate having at least one aperture for receiving a fastener for mounting the striker assembly to a mounting surface and grooved means for fixedly mounting said keeper to said mounting plate in a manner that prevents relative movement between said keeper and said mounting plate, said grooved means including two grooves;

said keeper comprising a rod having mounting portions nestingly received within said grooved means when mounted, said rod further including latch engaging portions integrally connected with said mounting portions and including a striker portion for engaging the latch, said mounting portions disposed on one side of said mounting plate and fixed to said mounting plate without extending through said mounting plate, said rod having a longitudinal axis, and wherein said longitudinal axis, at least along said mounting portions of said rod is disposed in generally parallel relation to said mounting plate.

15. A striker assembly as claimed in claim 14 wherein said mounting portions are welded to said mounting plate to fix said keeper to said mounting plate when said mounting portions are nested in said grooves.

16. A striker assembly as claimed in claim 15 wherein said mounting portions comprise two end portions each having an L-shape.

17. A striker assembly as claimed in claim 16 wherein said L-shape has a base and a stem and the bases of each end portion are directed in opposite directions.

18. A striker assembly as claimed in claim 17 wherein said L-shape has a base and a stem and the bases of each end portion are directed towards each other.

19. A striker assembly as claimed in claim 16 wherein said L-shape has a base and a stem and the bases of each end portion are directed away from each other.

20. A striker assembly as claimed in claim 19 wherein said striker assembly is heat treated.

21. A striker assembly as claimed in claim 20 wherein said striker assembly is heat treated until the keeper has a hardness of about Rc 30–40.

22. A striker assembly as claimed in claim 16 wherein said L-shape has a base and a stem and the bases of each end portion are directed in the same direction.

23. A striker assembly as claimed in claim 22 wherein said striker assembly is heat treated.

24. A striker assembly as claimed in claim 22 wherein said striker assembly is heat treated until the keeper has a hardness of about Rc 30–40.

* * * * *